United States Patent [19]

Nishiura et al.

[11] Patent Number: 4,837,562

[45] Date of Patent: Jun. 6, 1989

[54] SMOOTHING DEVICE

[75] Inventors: Masaaki Nishiura; Isei Minamitani, both of Fukaya, Japan

[73] Assignee: Kabushiki Kaisha Toshiba, Kawasaki, Japan

[21] Appl. No.: 83,003

[22] Filed: Aug. 7, 1987

Related U.S. Application Data

[63] Continuation of Ser. No. 760,409, Jul. 30, 1985, abandoned.

[30] Foreign Application Priority Data

Aug. 9, 1984 [JP] Japan ..... 59-165676

[51] Int. Cl.[4] ..... G09G 1/14

[52] U.S. Cl. ..... 340/728; 340/748

[58] Field of Search ..... 340/723, 728, 729, 744, 340/747, 748, 793, 703

[56] References Cited

U.S. PATENT DOCUMENTS 3,969,716 7/1976 Roberts ..... 340/728
4,079,367 3/1978 Yanezawa et al. ..... 340/728
4,486,785 12/1984 Lasher et al. ..... 340/728
4,544,922 10/1985 Watanabe et al. ..... 340/728
4,584,572 4/1986 Lambert, III ..... 340/728

FOREIGN PATENT DOCUMENTS 2097637 11/1982 United Kingdom ..... 340/728

OTHER PUBLICATIONS

IBM Technical Disclosure Bulletin, "Anti-Aliasing Vide Lookup Table", vol. 27, No. 10B, Mar. 1985.

*Primary Examiner*—John W. Caldwell, Sr.
*Assistant Examiner*—Jeffery A. Brier
*Attorney, Agent, or Firm*—Cushman, Darby & Cushman

[57] ABSTRACT

A special slanted line pattern is detected using pattern data of eight picture elements S0–S3, S5–S8 which surround a current display picture element S4. A half-picture element pattern provided on the current display picture element S4 and having a specified positional relationship to the detected pattern is added to this detected pattern, is deleted from the detected pattern, or is added to the detected pattern and given the same color as the detected pattern.

6 Claims, 21 Drawing Sheets

SMOOTHING DEVICE

This is a continuation of application Ser. No. 760,409, filed July 30, 1985, which was abandoned upon the filing hereof.

This invention relates to a smoothing device for smoothing the slanted line pattern in an image display.

Systems having an image display function such as videotex or teletext systems, are capable of displaying a character pattern. In this case, the character pattern is displayed by a plurality of pixels arranged in a matrix. Accordingly, if the character pattern shown is based on pattern data read out from the character generator, slanted lines (slanted line pattern) will become rough.

In order to solve this problem, smoothing of the slanted line pattern has been considered. Prior art smoothing apparatus perform this smoothing operation by adding a pattern that has half the pixel width (half-pixel pattern) to the slanted line pattern. However, with this kind of smoothing device, it was not possible to recognize the configulation of the slanted line pattern and, accordingly, when the character pattern [ ○ ] was displayed using four pixels, for example, the configulation would be buried by the half-pixel pattern, resulting in a [ ● ].

In order to solve this problem, a smoothing device which adds a pixel pattern having 1/3 the pixel width was considered. With this device, however, the [ ○ ] would be displayed as an ellipse.

SUMMARY OF THE INVENTION

The first object of the invention is to provide a smoothing device which can improve the image display effect by a smoothing process in which the smoothing process is applied only to a slanted line pattern that fulfills certain conditions.

The second object of the invention is to provide a smoothing device which can improve the image display effect of the smoothing process by eliminating a half-pixel pattern only from a slanted line pattern that fulfills certain conditions.

The third object of the invention is to provide a smoothing device which can improve the image display effect of the smoothing process by adding a half-pixel pattern to a slanted line pattern that fulfills certain conditions, said half-pixel pattern having the same color as the slanted line pattern.

In order to achieve the first object of the invention, the special slanted line pattern is detected using the pattern data of nine pixels, eight of which surround a current display pixel corresponding to an image scanning position. A half-pixel pattern having a prescribed relationship to this detected pattern is added to the detected pattern on the current display pixel.

In order to achieve the second object of the invention, the special slanted line pattern is detected using the pattern data of nine pixels, eight of which surround a current display pixel corresponding to an image scanning position. A half-pixel pattern having a prescribed relationship to this detected pattern is eliminated from the detected pattern on the current display pixel.

In order to achieve the third object of the invention, the special slanted line pattern is detected using the pattern data of nine pixels, eight of which surround a current display pixel corresponding to an image scanning position. A half-pixel pattern having a prescribed relationship to this detected pattern is colored by the color data of the detected pattern on the current display pixel, and this pattern is added to the detected pattern.

BRIEF DESCRIPTION OF THE DRAWINGS

The invention may be better understood with reference to the drawings in which.

DETAILED DESCRIPTION OF THE PREFERRED EMBODIMENT

The following is description, with reference to the drawings, of the preferred embodiments of the invention.

First, an outline of the smoothing process according to the first embodiment of the invention will be described with reference to FIGS. 1 to 16.

Figure 1:
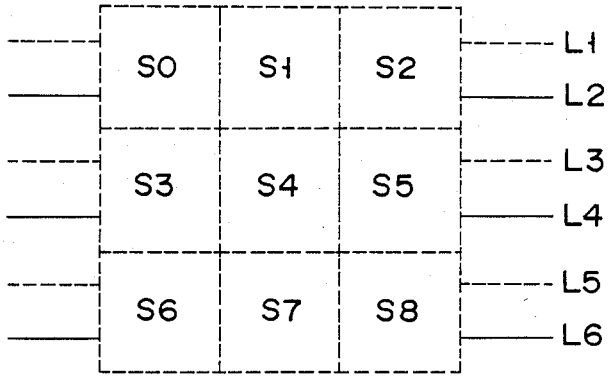
FIG. 1 shows a slanted pattern detection matrix as used in the smoothing device according to this invention.

As shown in FIG. 1, in this embodiment the configulation of the slanted line pattern are discriminated according to the pattern data of nine pixels S0–S8 arranged in a matrix, and only a specified pattern is detected.

Pixel S4, which is on the raster scanning position, is called the current display pixel, and is surrounded by pixels S0–S3, S5–S8. In other words, pixels S3, S5 are each on the currently displayed horizontal line (called the current horizontal line) before and after the current display pixel S4. Pixels S0–S2 are one line above the horizontal line (preceding horizontal line) and correspond to pixels S3–S5. Pixels S6–S8 are one line underneath the current horizontal line (succeeding horizontal line) and have the same positional relationship to pixels S3–S5.

Pixels S0–S8 are formed into two scanning lines based on the interlace scanning method. In FIG. 1, a broken line shows the odd field scanning line L (2m−1) and the solid line shows the even field scanning line L (2m). (m is an integer.) In this case, the pattern data stored in the picture memory is commonly used in both the even and odd fields.

Figure 2:
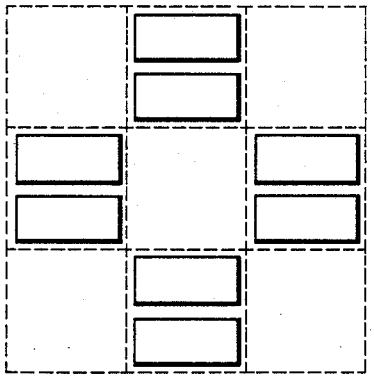
FIG. 2 shows a character pattern "○" which is detected by the matrix of FIG. 1.

If the pattern data corresponding to the nine pixels S0–S8, which have the positional relationship described earlier, are used, the character pattern [ ◯ ], which comprises four pixels, can be detected as shown in FIG. 2. Accordingly, when detecting a slanted line pattern, it is possible to remove the slanted line pattern forming the character pattern [ ◯ ] from the detected image, thereby preventing the [ ◯ ] from being shown as [ ● ].

Figure 3:
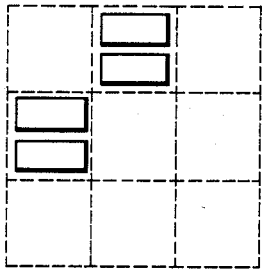
FIGS. 3 to 5 show a slanted pattern detectable by the matrix array of FIG. 1.
Figure 4:
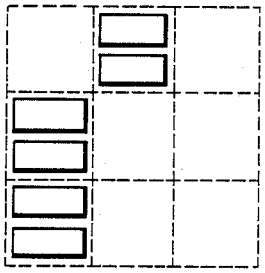
Figure 5:
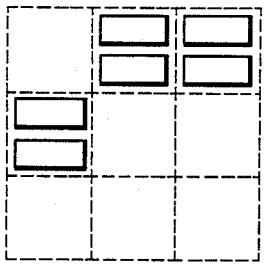

Slanted line patterns at 45°, 60° and 30° can be detected by the pattern data corresponding to the nine pixels S0–S8. One series of these patterns is shown in FIGS. 3–5.

In this embodiment, the 45° slanted line pattern is detected and the half-pixel pattern described above is added. The addition of the half-pixel pattern is carried out by using the current display pixel S4 and, accordingly, the slanted line pattern which comprises the current display pixel S4 can also be removed from the detected object.

The following is a description of the addition of this half-pixel pattern.

Figure 6:
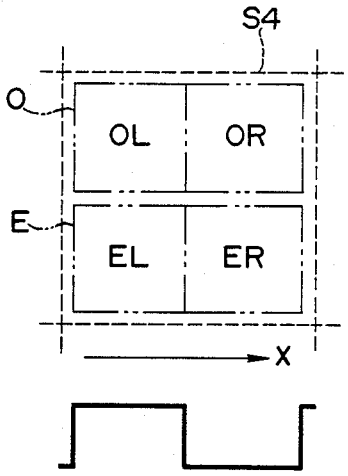
FIG. 6 shows picture regions divided on a currently detected picture element.

FIG. 6 shows a magnification of the current display pixel S4. As is shown, pixel 4 is divided into region O corresponding to the odd field and region E corresponding to the even field. Each of the regions O, E is divided into regions OL, OR and EL, ER in the central image scanning position.

The addition of the half-pixel pattern means displaying the divided region, as one part of the slanted line pattern. As will be described later, the removal of the half-pixel pattern means preventing the display of the divided region, on the detected slanted line pattern when the current display pixel S4 is a structural element of the slanted line pattern.

Figure 7:
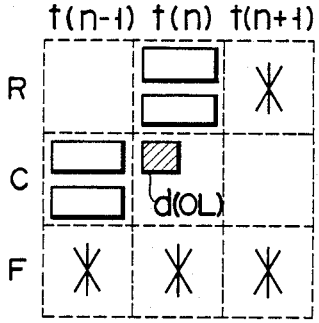
FIGS. 7 to 12 show a smoothing process for adding a half-pixel element.
Figure 8:
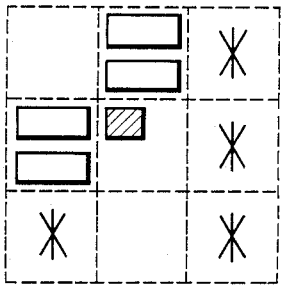
Figure 9:
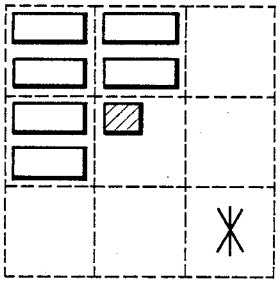

FIGS. 7–9 show the smoothing process of adding the half-pixel pattern d on the left (divided region OL) in an odd field. In this case, the detected slanted line pattern is a 45° pattern angled from the left downward and is expressed by pixels S1, S3.

In these drawings, the pixels with an asterisk * are pixels for which the presence or absence of data of a pattern portion is irrelevant.

Not detecting the slanted line pattern constituting part of the character pattern [ ◯ ] displayed by pixels S0–S9 means preventing at least one of pixels S1, S3, S5, S7 from becoming a structural element of the pattern. For example, in FIG. 7 pixel S5 is prevented from becoming a structural element of the pattern. Similarly, not detecting the slanted line pattern in which current display pixel S4 is a structural element is the same as preventing it from becoming a structural element.

Figure 10:
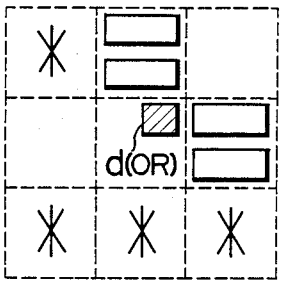
Figure 11:
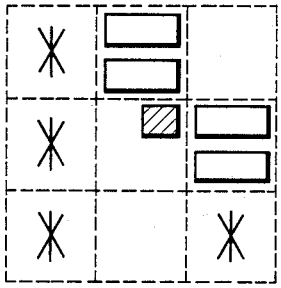
Figure 12:
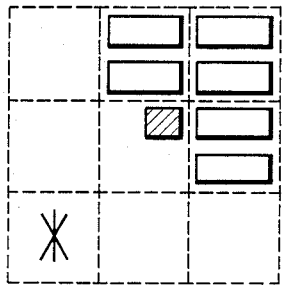

FIGS. 10–12 show the smoothing process of adding the half-pixel pattern d on the right (divided region OR) in the odd field. In this case the detected slanted line pattern is a 45° pattern angled from the right downward with a left-right symmetry, as is shown in each of the drawings.

Although not shown, in the smoothing process of adding the half-pixel pattern on the left (divided region EL) in the odd field, the slanted line pattern shown in FIGS. 7–9 is detected as a slanted line pattern having an up-down symmetry.

Similarly, in the smoothing process of adding the half-pixel pattern d on the right (divided region ER) in the even field, the slanted line pattern shown in FIGS. 10–12 is detected as a slanted line pattern having an up-down symmetry.

The position of adding the half-pixel pattern d is the point of contact between two pixels constituting the slanted line pattern.

In the first embodiment, the smoothing process consists not only of adding the half-pixel pattern d, but also includes deleting the half-pixel pattern.

Figure 13:
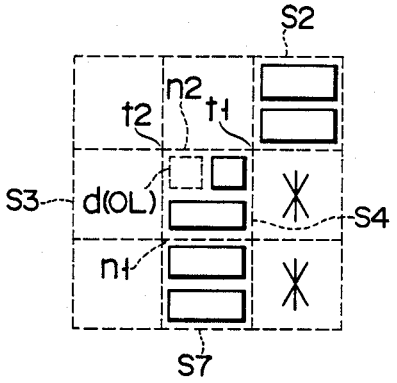
FIGS. 13 to 16 show the smoothing process for eliminating a half-pixel element.
Figure 14:
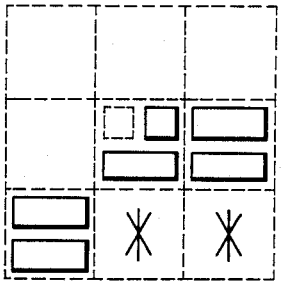

FIGS. 13 and 14 show the smoothing process of deleting the left half-pixel pattern d in the odd field. In this case, the detected slanted line pattern is angled left downward at 60°, as shown in FIG. 13, and at 30° in FIG. 14.

Figure 15:
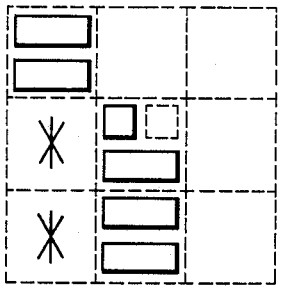
Figure 16:
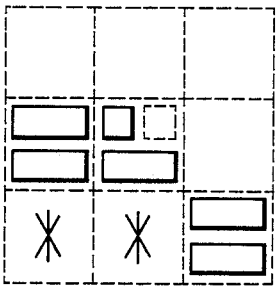

Similarly, when deleting the right half-pixel pattern d in the odd field, as shown in FIGS. 15 and 16, the slanted line pattern of FIGS. 13 and 14 is detected as having a left-right symmetry. Although not shown, in the processing of the even field, the slanted line pattern of FIGS. 13–16 are detected as having an up-down symmetry.

The following is a description of the position of deleting the half-pixel pattern d, using the example shown in FIG. 13.

The slanted line pattern shown in FIG. 13 comprises current display pixel S4 and pixels S2, S7. At the present, in the current display pixel S4, the side n1 contacting to pixel S7 is taken as the first side and the side n2 oppositing to the side nl is taken as the second side. Then, the half-pixel pattern d is deleted in the position corresponding to one end t2 opposite to other end t1 which is in contact with pixel S2 in the second side.

In the smoothing process of the first embodiment, however, the slanted line pattern need not necessarily be a slanted line pattern itself; part of any pattern (such as a contour) is also acceptable. This is clear from the use in FIG. 9, for example, of the pattern formed of pixels S0, S1, S3 as the object for detection. It is also clear from the pixels marked with an asterisk *. The above point is the same for the character pattern [ ◯ ] deleted from the detected object.

The conditions for detecting the slanted line pattern in the above smoothing process can be expressed by the following equations 1 to 5 (corresponding to the processes of FIGS. 7–9, 13 and 14).

(A) The condition for adding the half-pixel pattern d:

$$\overline{Rt(n-1)}\cdot Rt(n)\cdot Ct(n-1)\cdot\overline{Ct(n)\cdot Ct(n+1)}=1 \text{ (FIG. 7)} \quad (1)$$

$$\overline{Rt(n-1)}\cdot Rt(n)\cdot Ct(n-1)\cdot\overline{Ct(n)\cdot Ft(n)}=1 \text{ (FIG. 8)} \quad (2)$$

$$Rt(n-1)\cdot Rt(n)\cdot\overline{Rt(n+1)}\cdot Ct(n-1)\cdot\overline{Ct(n)}\cdot\overline{Ct(n+1)}\cdot\overline{Ft(n-1)}\cdot Ft(n)=1 \text{ (FIG. 9)} \quad (3)$$

(B) The condition for deleting the half-pixel pattern d:

$$\overline{Rt(n-1)}\cdot\overline{Rt(n)}\cdot Rt(n+1)\cdot\overline{Ct(n-1)}\cdot Ct(n)\cdot\overline{Ft(n-1)}\cdot Ft(n)=1 \text{ (FIG. 13)} \quad (4)$$

$$\overline{Rt(n-1)}\cdot\overline{Rt(n)}\cdot\overline{Rt(n+1)}\cdot\overline{Ct(n-1)}\cdot Ct(n)\cdot Ct(n+1)\cdot Ft(n-1)=1 \text{ (FIG. 14)} \quad (5)$$

Where:

tn: the pixel scanning timing

C: pattern data of current horizontal line

R: pattern data of horizontal line one line above current horizontal line (preceding horizontal line)

F: pattern data of horizontal line one line below current horizontal line (succeeding horizontal line)

(See FIG. 7)

The conditions for the detection of the pattern in the right half-pixel pattern d operation (either adding or deleting) in the odd field are that in equations (1) to (5) t(n−1) and t(n+1) be mutually interchangeable because of their left-right symmetry. The conditions for the detection of the pattern in the left half-pixel pattern d operation in the even field are that in equations (1) to (5) R nd F be mutually interchangeable because of their up-down symmetry. In the right half-pixel pattern d operation in the even field, the up-down symmetry and the left-right symmetry means that in equations (1) to (5) t(n−1) and t(n+1) can be mutually interchanged and R and F can be interchanged.

If the circuits are constructed based on these logic equations, the slanted line pattern, which is to have the half-pixel pattern d added or deleted, can be detected.

The following is a description of the circuit structure for realizing the above smoothing process.

Figure 17:
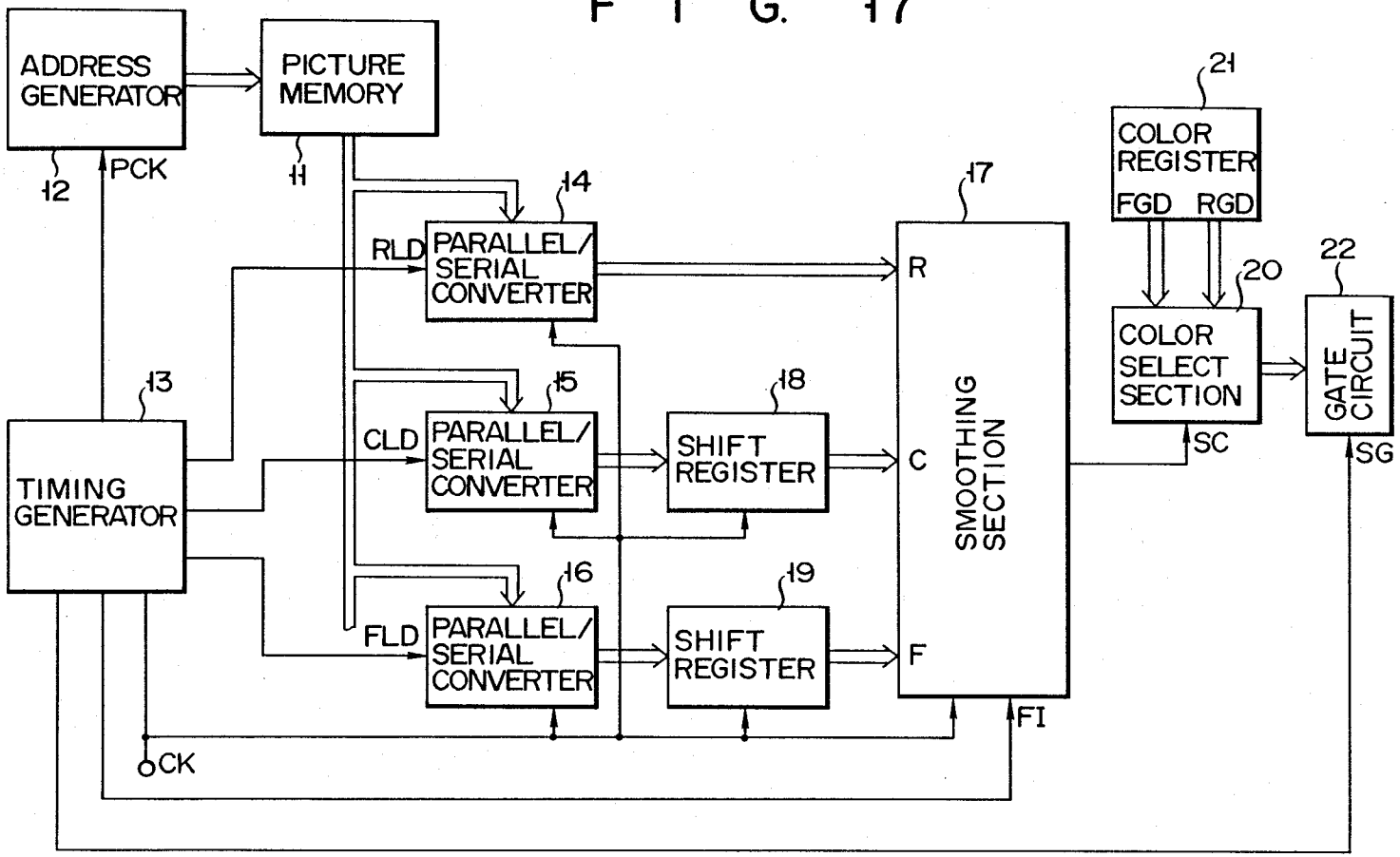
FIG. 17 shows in block diagram a first embodiment of this invention.
Figure 18:
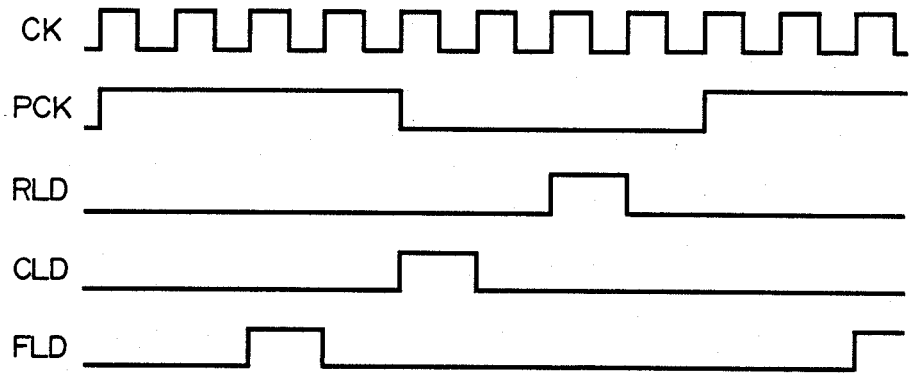
FIG. 18 shows a timing chart for the data read operation of the smoothing device, shown in FIG. 17.

FIG. 17 is a block diagram of the entire structure. Eight pixels of pattern data are read from picture memory 11 at a time. The address data required for reading out is output by address generator 12. This address data is renewed at the leading edge of the pattern clock PCK supplied from timing generator 13. As shown in FIG. 18, pattern clock PCK is a pulse obtained by dividing the display clock CK, which is used for the display timing of each pixel unit, into eight. The eight-pixel pattern data read out from picture memory 11 in an eight-pixel image display period is supplied to the image display in the following eight-pixel display period.

In this embodiment, the pattern data of the current horizontal line and the horizontal lines above and below are used. Therefore, when reading out of pattern data from picture memory 11 the upper and lower horizontal lines are read out as well as the current horizontal line. The eight-pixel pattern data out of the upper and lower horizontal lines is read out in parallel the same as the current horizontal line.

The pattern data of each horizontal line is respectively loaded into parallel/serial converters 14, 15, 16 in accordance with load pulses RLD, CLD, FLD shown in FIG. 18, and is supplied from the converters to smoothing section 17 in accordance with display clock CK. Shift registers 18, 19 compensate the load timing of the pattern data of each horizontal line so that the time axis of the pattern data between the three horizontal lines matches.

Figure 19:
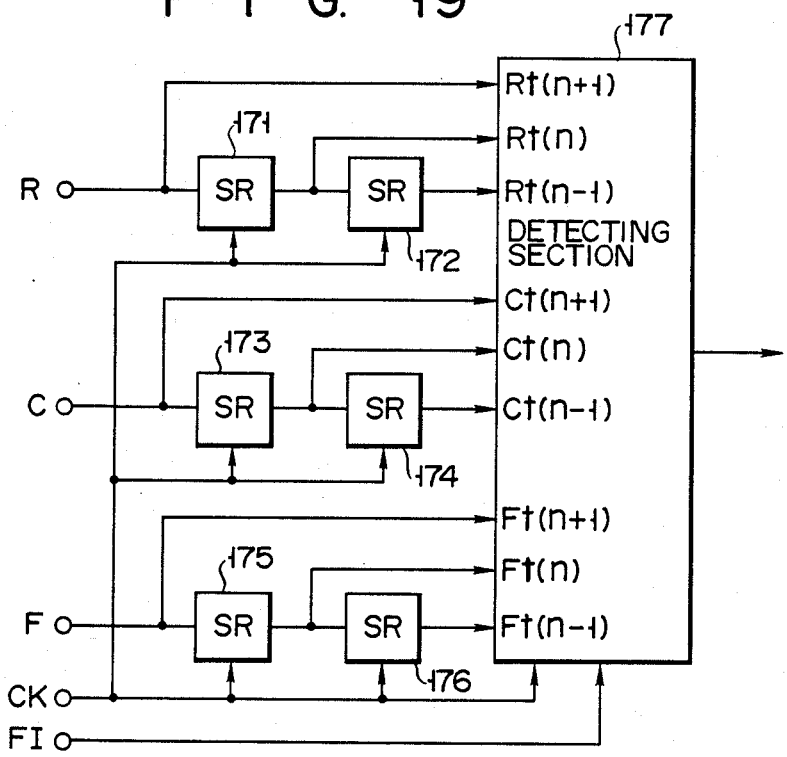
FIG. 19 shows in block diagram one practical form of a smoothing section of the device shown in FIG. 17.

FIG. 19 is a circuit diagram of smoothing section 17. The pattern data, whose time axis between each horizontal line is to be matched, is supplied to detection section 177 for each horizontal line after having the time axis matched by shift registers 171–176.

Figure 20:
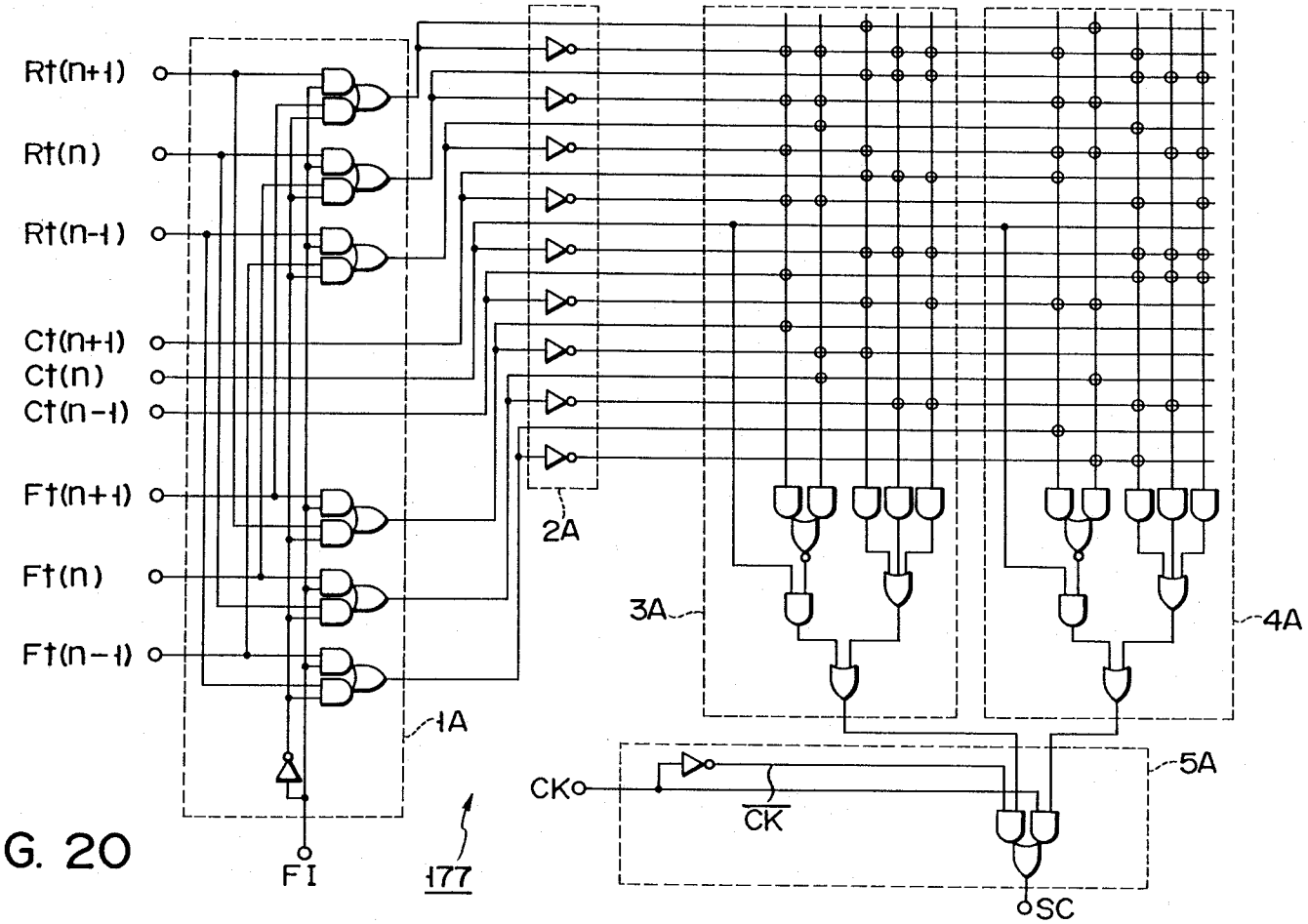
FIG. 20 shows in detail a detection section in the smoothing section shown in FIG. 19.

FIG. 20 is a circuit diagram of detection section 177. The image data of nine pixels whose time axis has been matched is first supplied to field conversion section 1A. Field conversion section 1A mutually interchanges R and F between the even fields based on field index signal FI supplied from timing generator 13 shown in FIG. 17. Then, in the next stage the same process is carrier out for the odd field.

Polarity inverter 2A outputs the nine pattern data supplied from field conversion section 1A and the nine polarity inverted data. This data from polarity inverter 2A is supplied to first and second detection sections 3A and 4A shown in the PLA (programmable logic array.)

First detection section 3A detects the slanted line pattern that is to have the left half-pixel pattern d operation performed, second detection section 4A detects the slanted line pattern that is to have the right half-pixel pattern d operation performed. When detection sections 3A and 4A detect the slanted line pattern that is to have half-pixel pattern d added to it, a high level signal is output, and when deletion is to be performed, a low level signal is output.

The outputs of detection sections 3A, 4A are supplied to adding section 5A. Adding section 5A selects divided regions OL, OR, EL, ER based on these outputs, and outputs control signal SC for adding or deleting half-pixel pattern d. Recognition of divided regions OL, OR, EL, ER in adding section 5A is carried out based on display clock CK. Namely, as was shown in FIG. 6, display clock CK is a pulse train with a duty of 1:1 such that it is at a high level for divided regions OL, EL, and at a low level for regions OR, ER. Accordingly, if the polarity of display clock CK is monitored, it is possible to discriminate the different divided regions.

In regards to the circuitry, Adding section 5A obtains control signal SC by selecting the detection outputs of detection sections 3A, 4A, which are output based on display clock CK and its inverted clock CK. Control signal SC is at high level when the half-pixel pattern is added, and at low level when it is deleted.

Figure 21:
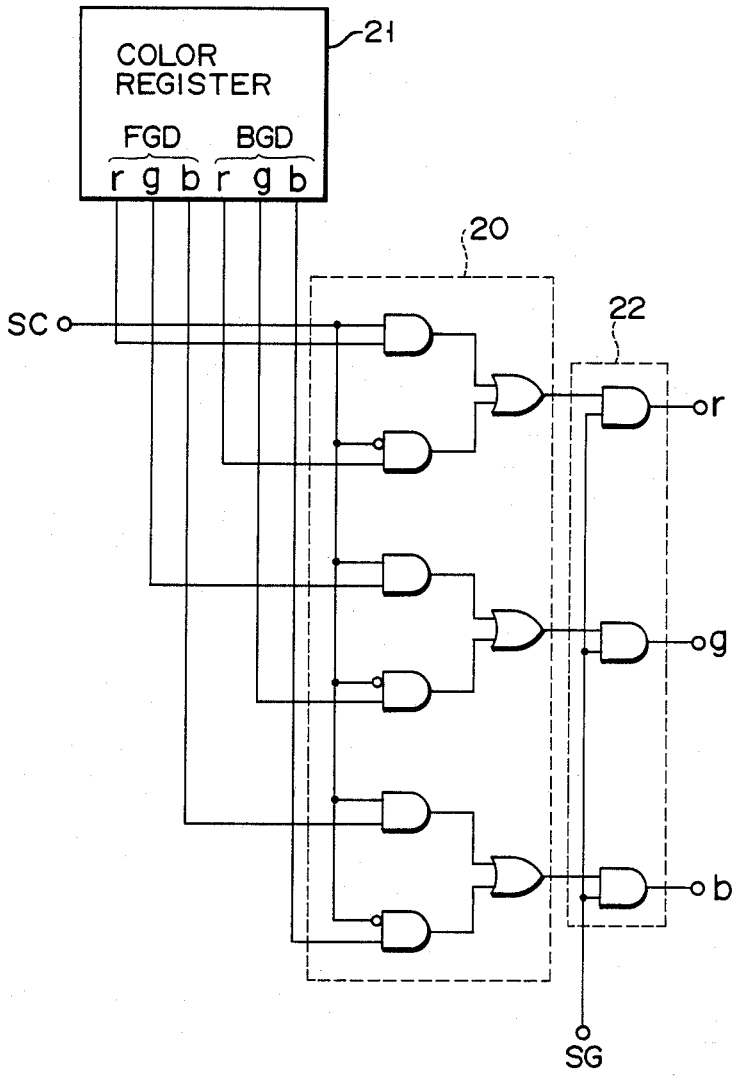
FIG. 21 shows one practical form of a circuit including a color selection section, color register and gate circuit in the device shown in FIG. 17.

This control signal SC is supplied to color selection section 20. (See FIG. 17.) Color selection section 20 is constructed as shown in FIG. 21. With this kind of structure, when control signal SC is at the high level, color selection section 18 selects the foreground data (FGD) supplied from color register 21 (see FIGS. 17, 21), and selects the background data (BGD) when it is at the low level.

The foreground data FGD is a character pattern, i.e., color data for the foreground, and the background data BGD is for all the areas other than the character pattern, or, color data for the background. Color data FGD, BGD comprises three bits of data for red r, green g and blue b, and can express eight colors.

The output of color selection section 20 is supplied to gate circuit 22 (see FIGS. 17, 21), where only the image display period is selected according to gate signal SG supplied from timing generator 13, and it is then supplied to a CRT drive circuit (not shown).

Detection sections 3A, 4A output a high level signal when deletion of the half-pixel pattern d is not necessary the same as when adding the half-pixel pattern, even if current display pixel S4 is a part of the pattern structure. Accordingly, foreground data FGD is selected by color selection section 20. Detection sections 3A, 4A output a low level signal when addition of the half-pixel pattern d is not necessary the same as when deleting the half-pixel pattern, even if current display pixel S4 is a part of the pattern structure. Accordingly, background data BGD is selected by color selection section 20.

As was described above, according to this embodiment, the contents or the configulations of the slanted line pattern are recognized, and by detecting only certain slanted line patterns, it is possible to solve the problem of the prior art.

Figure 22:
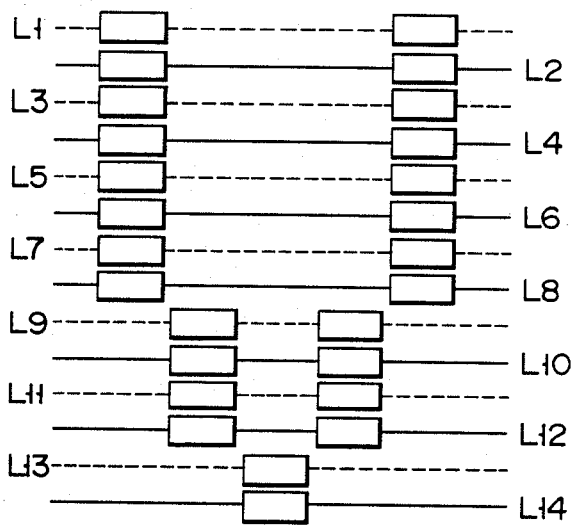
FIGS. 22 to 24 show a different character pattern.
Figure 23:
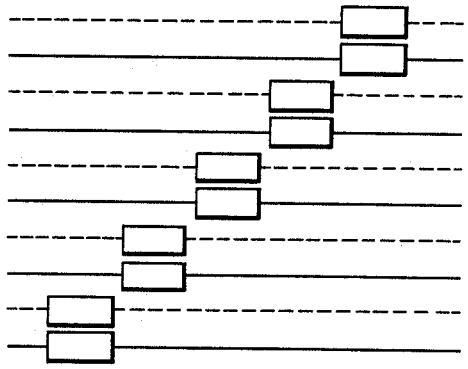
Figure 24:
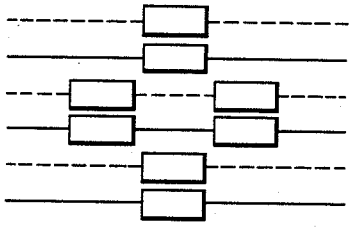
Figure 25:
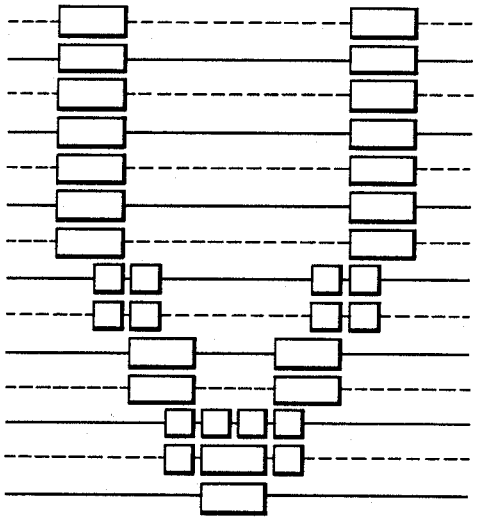
FIGS. 25 to 27 corresponding to FIGS. 22 to 24, show the state of a character pattern smoothly processed by the device of this invention.
Figure 26:
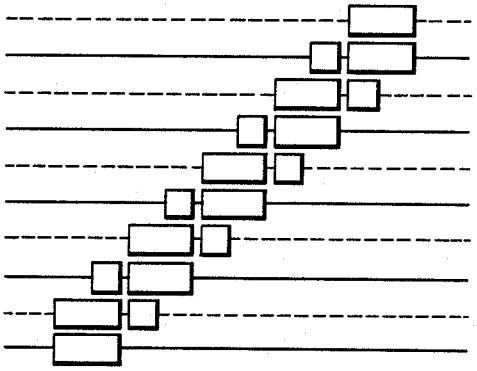
Figure 27:
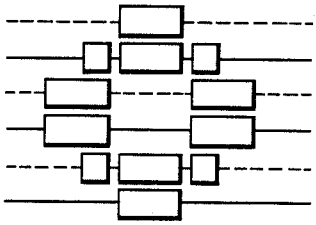
Figure 28:
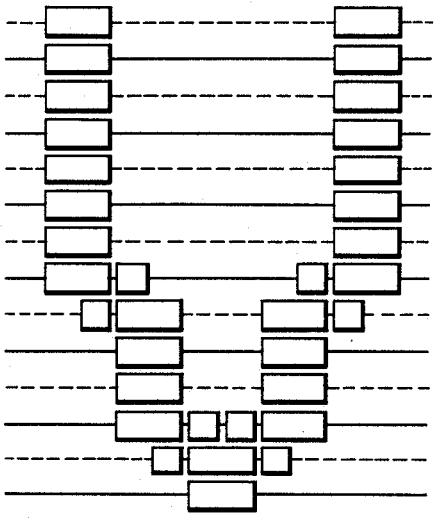
FIG. 28 (PRIOR ART)
FIGS. 28 to 30, corresponding to FIGS. 22 to 24, show the states of character patterns smoothly processed by a conventional smoothing device.
Figure 29:
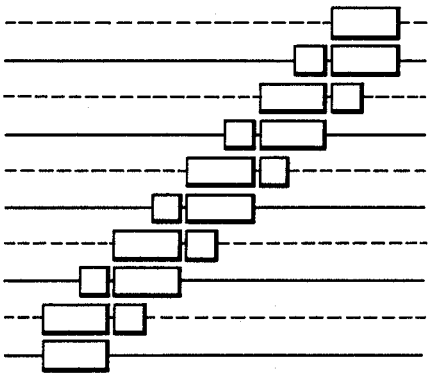
FIG. 29 (PRIOR ART)
Figure 30:
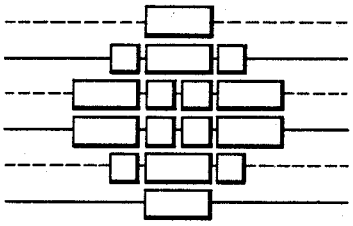
FIG. 30 (PRIOR ART)

The following is a comparison of the smoothing process of this invention and that of the prior art. FIGS. 22–24 show the character patterns "v", "/", "O" without smoothing, FIGS. 25–27 show the same character patterns after smoothing performance according to this embodiment, and FIGS. 28–30 show the prior art smoothing process of only adding the half-pixel pattern. In this smoothing process, the configulation of the slanted line pattern are not recognized, so the character pattern " ◯ " is shown as " ● ". Also, since deletion of the half-pixel pattern is not performed, the "v" has a distinctly rougher appearance than in the case of this embodiment.

Figure 31:
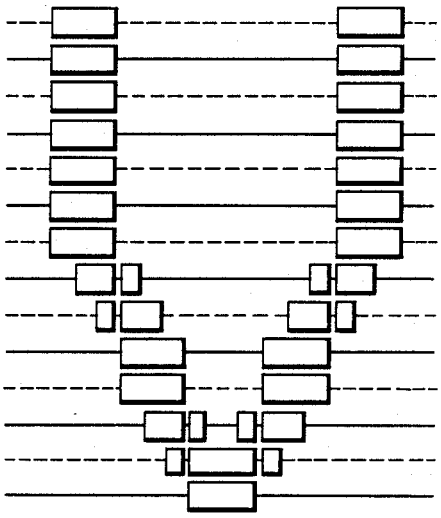
FIG. 31 (PRIOR ART)
FIGS. 31 to 33, corresponding to FIGS. 22 to 24, show the states of character patterns smoothly processed by another conventional smoothing device.
Figure 32:
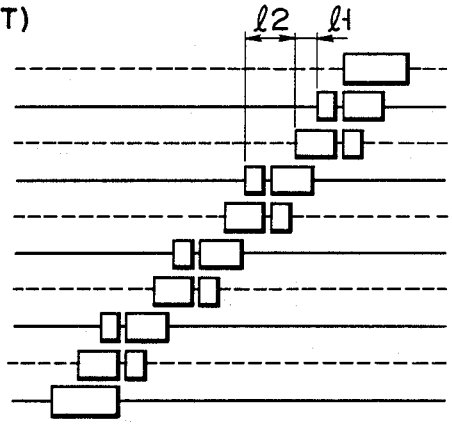
FIG. 32 (PRIOR ART)
Figure 33:
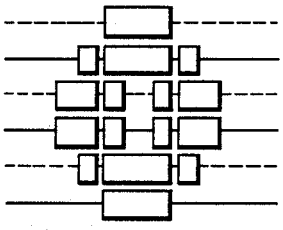
FIG. 33 (PRIOR ART)

FIGS. 31–33 show the prior art smoothing operation of adding a $\frac{1}{3}$ pixel pattern. Consideration in this case is given to deletion of the $\frac{1}{3}$ pixel pattern as well, so the same drawings also show this smoothing process. In this particular smoothing process, the size of the pattern to be added is varied without consideration of the contents of the slanted line pattern, in order to solve the previously mentioned problem of the prior art. Accordingly, while the above problem is solved, the character pattern " ◯ " becomes eliptic, as is shown in FIG. 33. Also, the character pattern "/" has a relationship $l_1 < l_2$ (see FIG. 32) so it becomes stepped.

Figure 34:
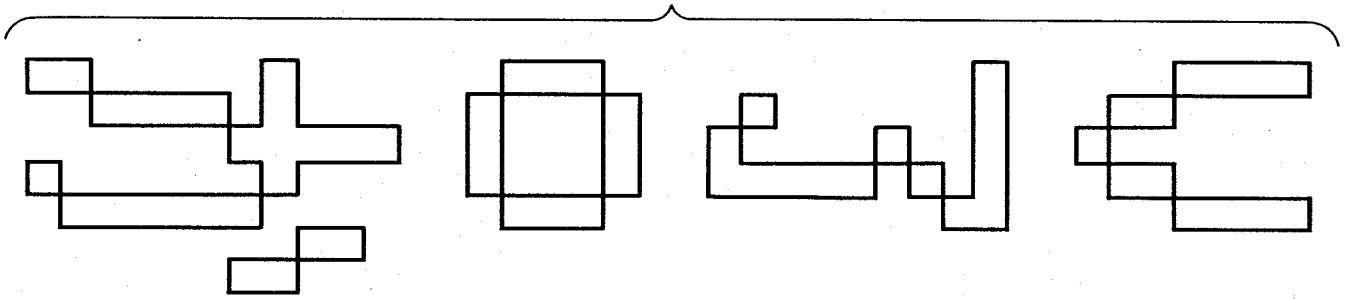
FIG. 34 shows another example of character patterns.
Figure 35:
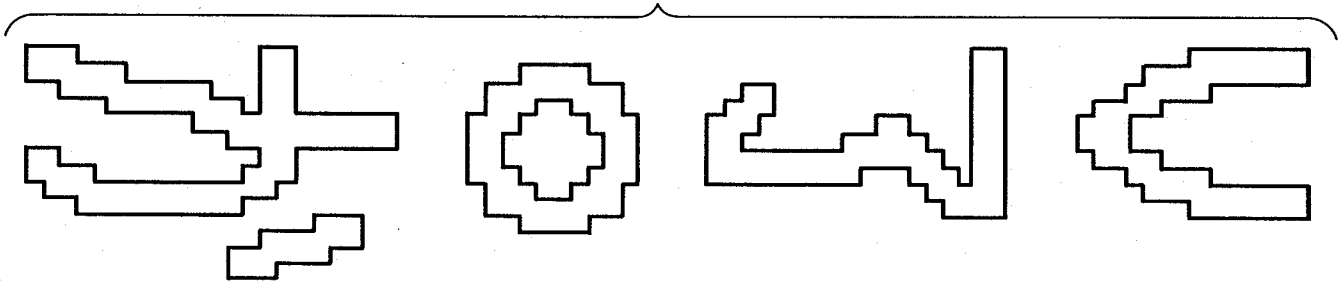
FIG. 35 shows the state of characters obtained by smoothly processing the character patterns shown in FIG. 34.

FIG. 35 shows the character pattern of FIG. 34 after smoothing according to this embodiment has been performed.

The following is a description of the second embodiment of this invention. In the second embodiment the addition of half-pixel pattern d is performed not only for slanted line patterns that have an inclination of 45°, but also for those having an inclination of approximately 60° and 30°.

Figure 36:
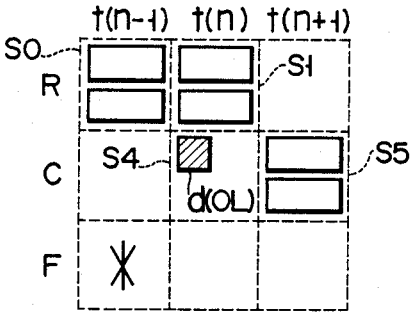
FIGS. 36 to 39 each show the character pattern to which a half-pixel element is added according to a second embodiment of the invention.
Figure 37:
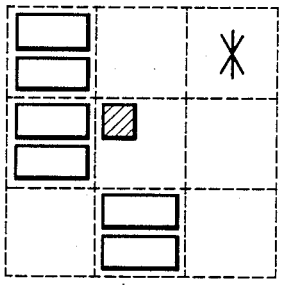
Figure 38:
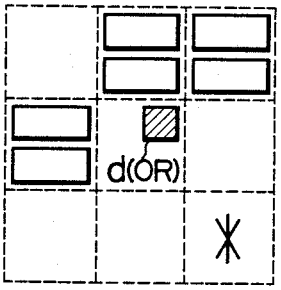
Figure 39:
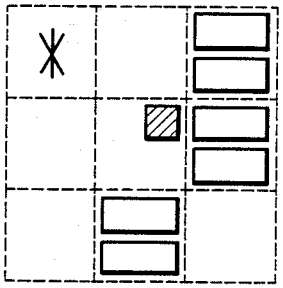

FIGS. 36 and 37 show the smoothing operation of adding the left half-pixel pattern in the odd field. FIGS. 38 and 39 show the smoothing operation of adding the right half-pixel pattern. For the even field, although not shown, the half-pixel pattern d is added to the slanted line patterns of FIGS. 36–39 having an up-down symmetry.

The position of adding the half-pixel pattern d is explained using FIG. 36 as an example. The pattern shown in the drawing is comprised of pixel S1, which is in contact with a side of current display pixel S4, pixel S0, which is in contact with a point of current display pixel S4, and pixel S5, which is in contact with the side of current display pixel S4 and in point contact with pixel S1. In this case, half-pixel pattern d is added at the point of contact between current display pixel S4 and pixel S0.

The conditions for detecting the slanted line pattern shown in FIGS. 36 and 37 are shown in the following equations (6) and (7).

$$Rt(n-1)\cdot Rt(n)\cdot\overline{Rt(n+1)}\cdot\overline{Ct(n-1)}\cdot\overline{Ct(n)}\cdot Ct(n+1)\cdot\overline{Ft(n)}\cdot\overline{Ft(n+1)}=1 \text{ (FIG. 36)} \quad (6)$$

$$Rt(n-1)\cdot\overline{Rt(n)}\cdot Ct(n-1)\overline{Ct(n)}\cdot\overline{Ct(n+1)}\cdot\overline{Ft(n-1)}\cdot Ft(n)\cdot\overline{Ft(n+1)}=1 \text{ (FIG. 37)} \quad (7)$$

The detection conditions of the slanted line pattern shown in FIGS. 38 and 39 and the detection conditions for the slanted line pattern in the even field t(n−1) and t(n+1) may be mutually interchanged using the left-right and up-down symmetry, the same as was the case in the previous embodiment.

Figure 40:
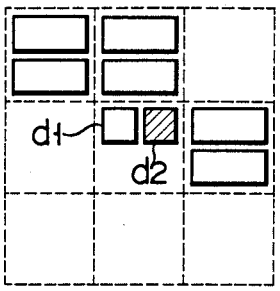
FIG. 40 shows the state of a pattern including a half-pixel element processed by the first embodiment and a half-pixel pattern processed by the second embodiment of this invention.

The 60° and 30° slanted line patterns include the 45° slanted line pattern so the smoothing process that is performed for the 45° slanted line pattern shown in FIG. 40 is also performed for these patterns. The smoothing operation of adding half-pixel pattern d1 is performed by detecting the 30° slanted line pattern shown in FIG. 36, and half-pixel pattern d2 for addition is added by detecting the 45° slanted line pattern shown in FIG. 10 or 11.

The following is a description of the circuit structure of this embodiment. Except for slanted line detection section this circuit structure is almost entirely the same as in the first embodiment.

Figure 41:
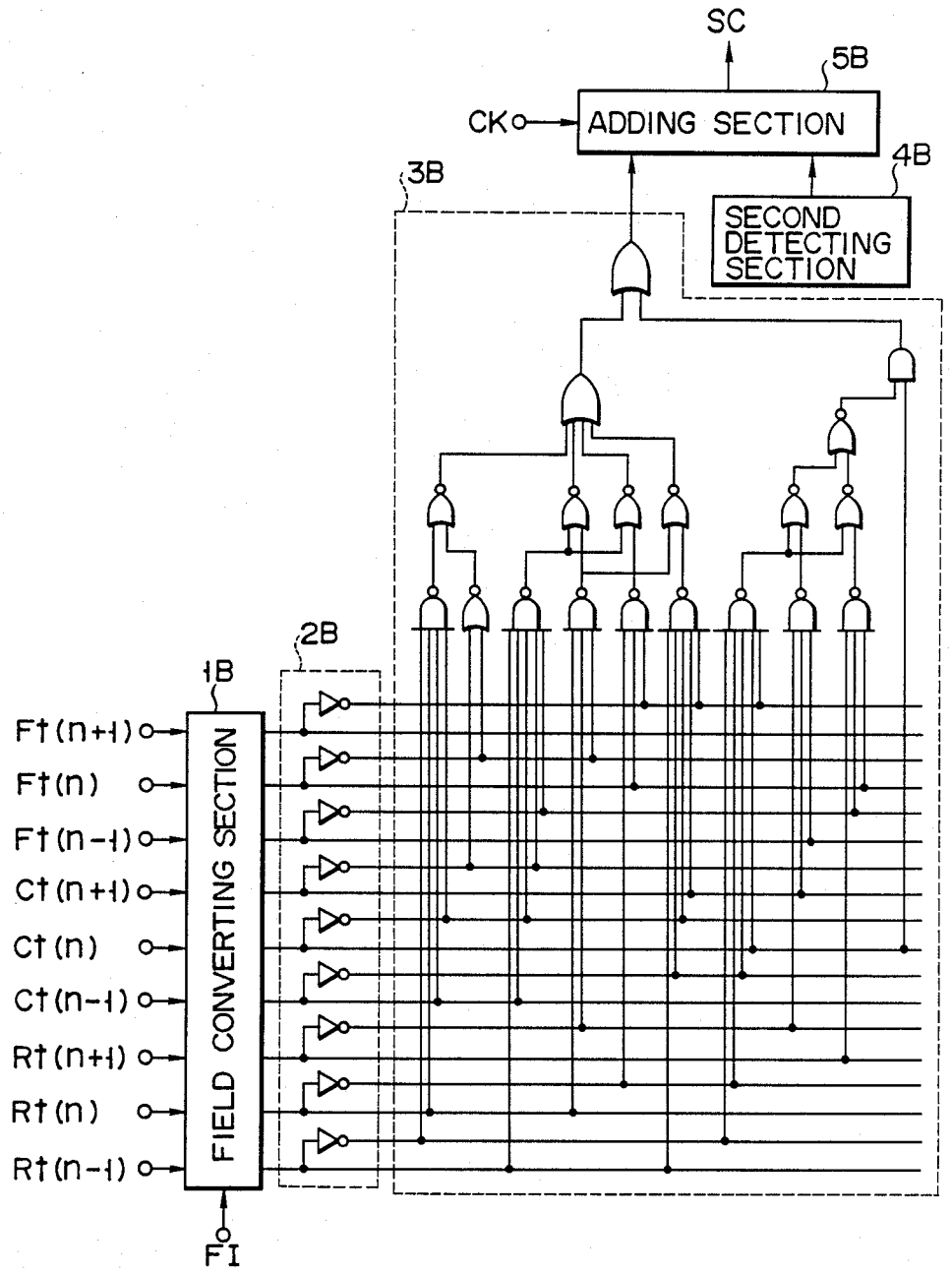
FIG. 41 shows a major circuit section of the second embodiment of this invention.

FIG. 41 shows the slanted line pattern detection section. Reference numerals 1B, 2B, 5B correspond to the circuits of field conversion section, polarity inversion section and adding section of FIG. 20, and have the same operation. First detection section 3B detects the slanted line pattern for operation of the left half-pixel pattern d, and second detection section 4B detects the slanted line pattern for operation of the right half-pixel pattern d. Second detection section 4B is constructed almost entirely the same as first detection section 3B except that t(n−1) and t(n+1) are interchanged.

First and second detection sections 3B and 4B are different from detection sections 3A, 4A shown in FIG. 20 only in that the slanted line pattern to which half-pixel pattern d is to be added has been included.

Figure 42:
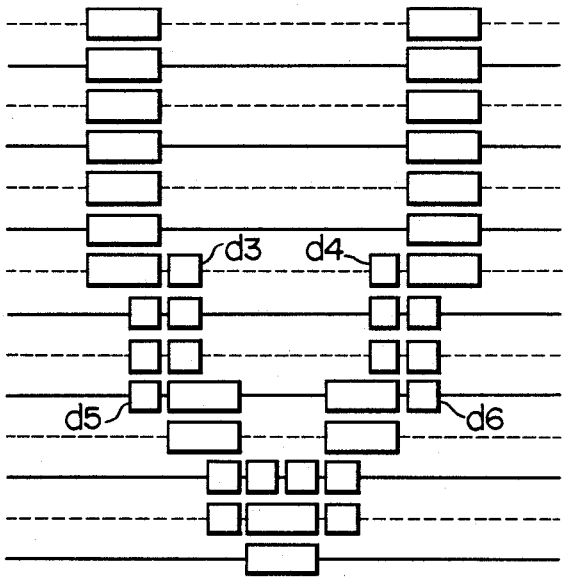
FIG. 42 shows on example of a character pattern smoothly processed by the second embodiment of the invention.

In this embodiment, half-pixel pattern d is added to the 30° and 60° slanted line patterns as well. Accordingly, the smoothing of the slanted line pattern is improved. FIG. 42 shows the character patter "v" after having been smoothed by this embodiment. When FIG. 42 is compared with FIG. 25, FIG. 42 shows an image that is smoother by the amount that half-pixel patterns d3–d6 have been added.

Half-pixel patterns d3 and d4 are added by the smoothing process shown in FIGS. 37 and 39, and half-pixel patterns d5 and d6 are smoothed by detecting of slanted line patterns having an up-down symmetry as shown in FIGS. 39 and 37.

The following is a description of the third embodiment of this invention. In this embodiment, it is always possible to match the colors of the half-pixel pattern and the color of the slanted line pattern, when the half-pixel pattern is added to the slanted line pattern.

Generally in a teletext system, blocks formed of four horizontal pixels and four vertical pixels are taken as one unit and the foreground FG and background BG are specified. With this kind of coloring system, when the half-pixel pattern is placed on the boundary line of this block, the color of the half-pixel pattern will be different from the color of the slanted line pattern.

This problem will be explained with reference to FIG. 43 which shows the addition of half-pixel pattern d to the character pattern "/". Four blocks MB1-MB4 comprised of 4×4 pixels for a total of 16 pixels each are shown. The character pattern "/" is formed across two blocks MB2 and MB3. For both of these blocks the color white has been specified as the foreground color FG and blue for the background. Thus, the character pattern "/" is shown with white on a blue background. This is the same for the half-pixel pattern d which is located inside blocks MB2 and MB3. However, the color of half-pixel patterns d7, d8 located in blocks MB1 and MB4 are black because the blocks MBl and MB4 have had black designated as the foreground FG color. Consequently, the white character pattern "/" will have those two portions (white and black), resulting in a poor image.

In this embodiment, however, the coloring of the half-pixel pattern d is not carried out based on the foreground color of the block in which it is located, but rather the coloring of the half-pixel pattern d is carried out based on the color of the slanted line pattern to which the half-pixel pattern d is to be added.

This process will h described with reference to FIGS. 7–9, 36 and 37, which show an example of adding the right half-pixel pattern d in the odd field. The slanted line pattern detected to add the half-pixel pattern d has a structural element of either pixel S3 on the left side of current display pixel S4 or pixel S5 on the right side of current display pixel S4. In this embodiment, when detection of the slanted line pattern is carried out, it is determined whether it is the structural element of the left or right side pixel S3 or S5, and based on the result, the color of the half-pixel pattern d is determined. In other words, the half-pixel pattern d is colored by the foreground FGB data of the pixel, either S3 or S5, which is a structural element of the slanted line pattern.

The following is a description of the circuit structure of this embodiment. The same as with the second embodiment, this description is of the addition of the half-pixel pattern d to the three slanted line patterns 45°, 60° and 30°, and the deletion of the half-pixel pattern d from the 60° and 30° slanted line patterns.

Figure 44:
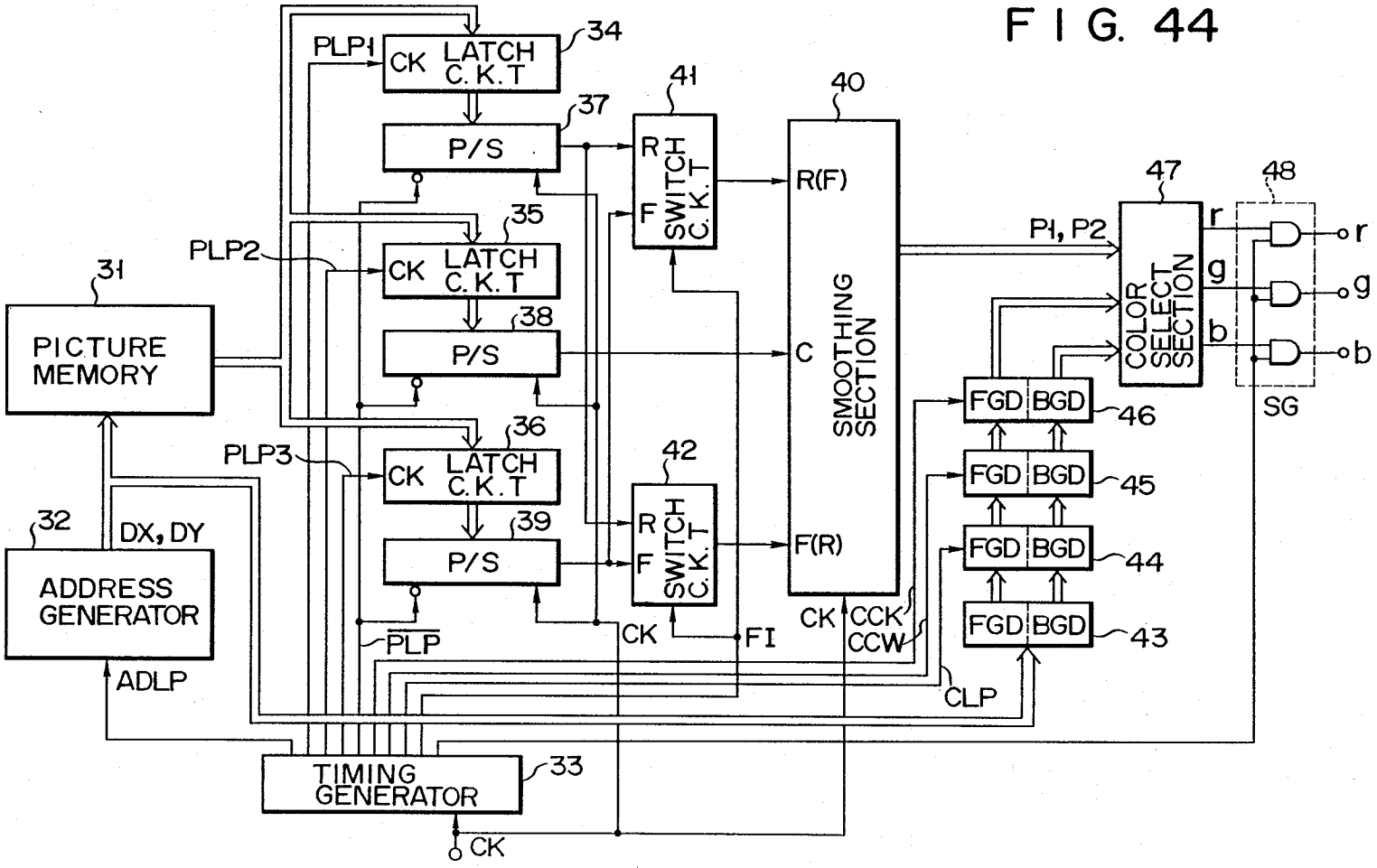
FIG. 44 shows in block diagram a whole circuit arrangement of the third embodiment of the invention.

FIG. 44 is a detailed block diagram of the entire structure of the third embodiment. First, a description will be given of the structure for reading three lines of image data from picture memory 31 and matching time axes of the lines.

Figure 45:
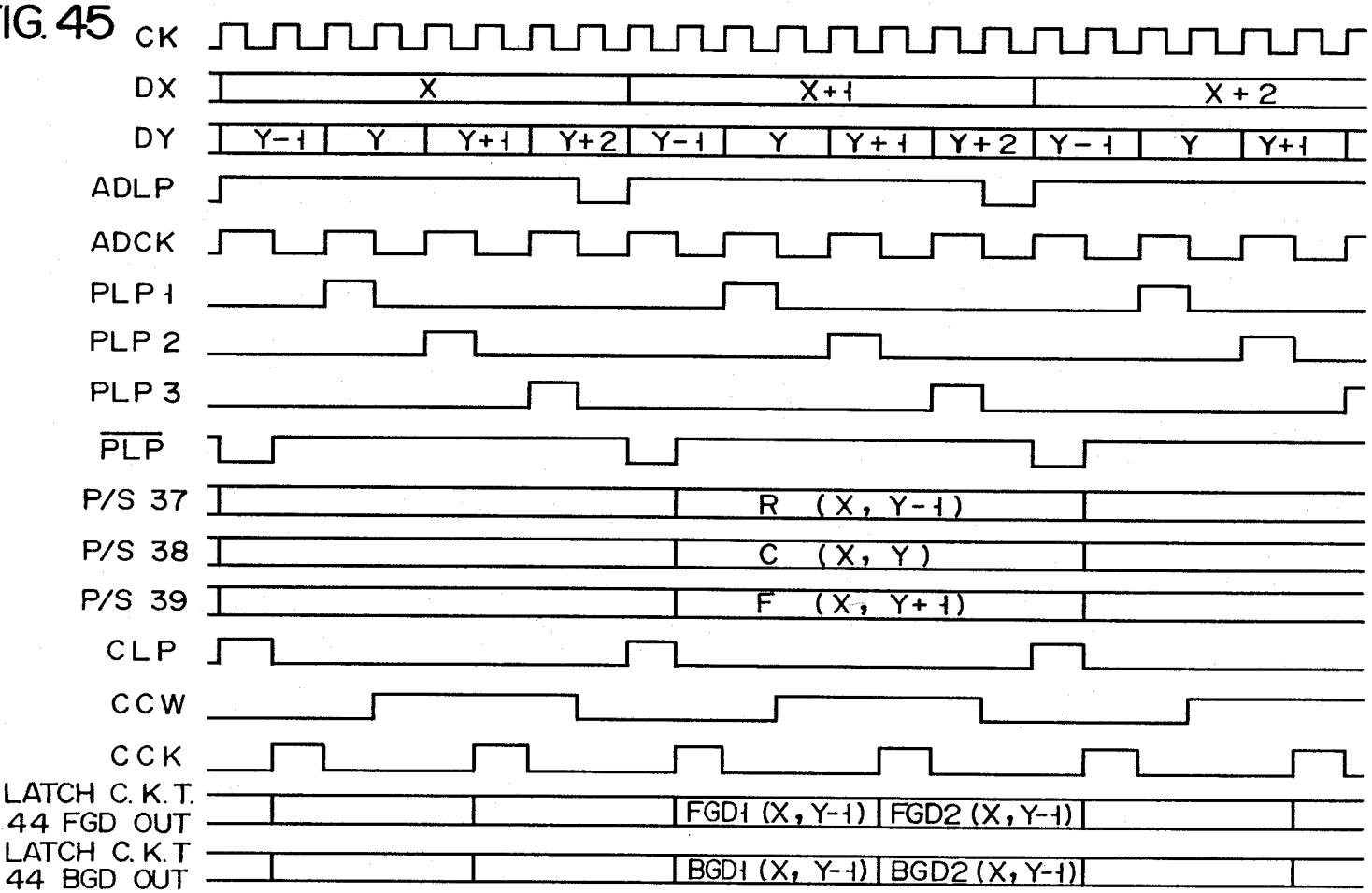
FIG. 45 shows a timing chart for explaining the operation of the third embodiment.

Picture memory 31 is a two-dimensional memory in which the address is prescribed by the horizontal and vertical coordinates of the display image. Address generator 32, which generates the address data for reading out of pattern data from picture memory 31, renews the address data D in the horizontal direction with a display period of eight pixels as one cycle, as shown in FIG. 45. Address generator 32 also sequentially renews the three address data DY in the vertical direction, which correspond to the current horizontal line and the lines above and below it, every eight-pixel display period. This address control is performed by control signal ADLP and ADCK from timing generator 33, which operates using the display clock CK as a reference clock.

The eight-pixel pattern data of the preceding line read out from the address designated by address data x, y−1 is latched by latch circuit 34 based on latch pulse PLP1 from timing generator 33, as shown in FIG. 44. Similarly, the eight-pixel pattern data if the current horizontal line designated by address data x, y and the eight-pixel pattern data of the succeeding line designated by address data x, y+1 are also latched by latch circuits 35, 36 based on latch pulses PLP2 and PLP3.

The pattern data latched by latch circuits 34, 35 and 36 is simultaneously loaded into parallel/serial converters (P/S) 37, 38 and 39 based on load pulse $\overline{PLP}$ from timing generator 33 (see FIG. 44.), and the time axes between the lines of the pattern data are matched.

The pattern data loaded into parallel/serial converters 37–39 is supplied to a smoothing section 40 by one pixel based on display clock CK. The preceding and succeeding line image data R and F are interchanged by switch SW 41 and 42 in the odd and even fields based field index signal FI for inputting to smoothing section 40. Therefore, in a later stage, it is possible to carry out exactly the same processing in each field.

Smoothing section 40 matches the time axes of the nine pattern data corresponding to the nine pixels S0–S8 shown in FIG. 1, by using the shift registers 171–176 shown in FIG. 19. The structure for detecting a prescribed slanted line pattern using the nine pattern data whose time axes have been matched is shown in FIGS. 45 and 46.

Figure 46:
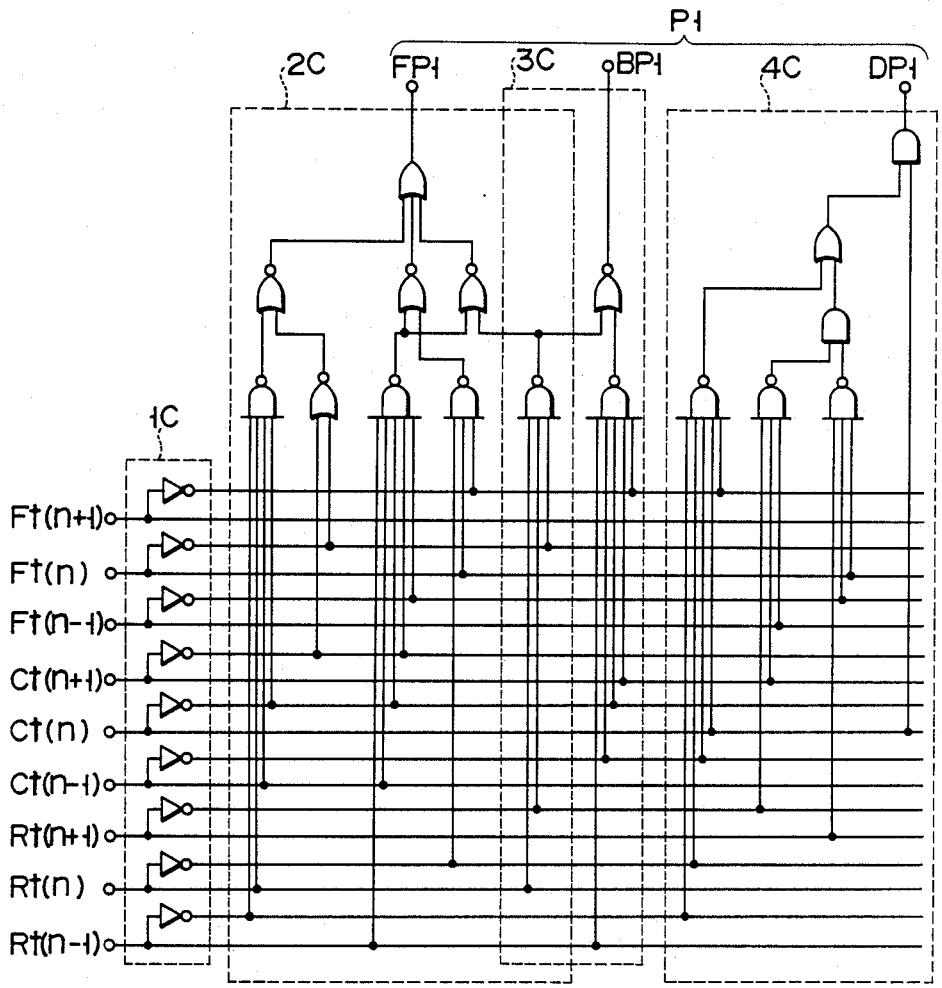
FIGS. 46 to 47 show a circuit arrangement of a detection section in a smoothing unit of the third embodiment shown in FIG. 44.

In FIG. 46, reference numeral lC refers to the same polarity inverter 2A shown in FIG. 20, which outputs the nine pattern data, which are the same as the input data, and their inverted nine pattern data. First detection section 2C detects the slanted line pattern to which the right half-pixel pattern d is to be added and which is a structural element of pixel S3 on the left side of current display pixel S4. Second detection section 3C detects the slanted line pattern to which the right half-pixel pattern d is to be added and which is a structural element of pixel S5 on the right side of current display pixel S4. Third detection section 4C detects the slanted line pattern from which the right half-pixel pattern is deleted.

Figure 47:
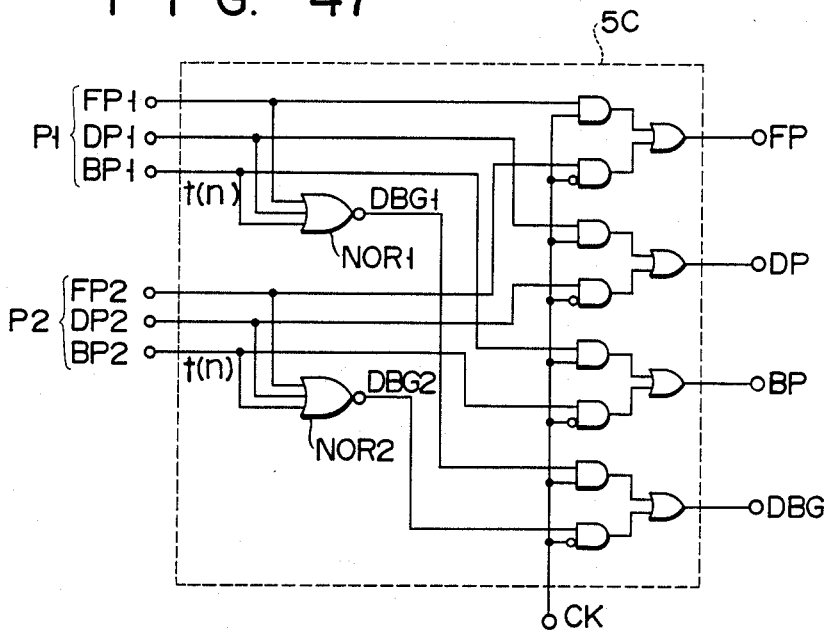

The detection outputs P1 (FP1, BP1, DP1) of these three detection sections 2C, 3C, 4C are supplied to addition section 5C shown in FIG. 47. The outputs FP2, BP2, DP2 of the detection section for detecting the slanted line pattern to which the right half-pixel pattern d is to be added or deleted are also supplied to addition section 5C. This detection section is not shown but is constructed such that t(n−1) and t(n+1) of detection sections 2C–4C are interchanged.

Addition section 5C shown in FIG. 47 selects two signals P1 (=FP1, DP1, BP1) and P2 (=FP2, DP2, BP2) based on the polarity of display clock CK to obtain the foreground gate signals FP, DP, BP. Addition section 5C also selects, based on display clock CK, signal DBG1 obtained by signal P1 passing through NOR circuit NOR1, and signal DBG2 obtained by signal P2 passing through NOR circuit NOR2, in order to obtain background gate signal DBG.

Signals FP1, BP1, FP2, BP2 become high level when the half-pixel pattern d is added, and low level when it is not added. Signals DP1, DP2 become low level when pixel pattern d is deleted, and high level when it is not deleted. Accordingly, when half-pixel pattern d is added, gate signal FP or BP is high level and foreground data FGD is selected, and when half-pixel pattern d is deleted, gate signal DBG becomes high level, and background data is selected. Gate signal DBG also becomes high level when half-pixel pattern d is not added even if current display pixel S4 is not a structural element of the character pattern, and background data BGD is selected. Gate signal DP becomes high level when half-pixel pattern d is not deleted even if current display pixel S4 is not a structural element of the character pattern, and foreground data FGD is selected.

The following is a description of the structure for selecting foreground data FGD and background data BGD based on the signals FP, DP, BP, DBG described above.

Figure 43:
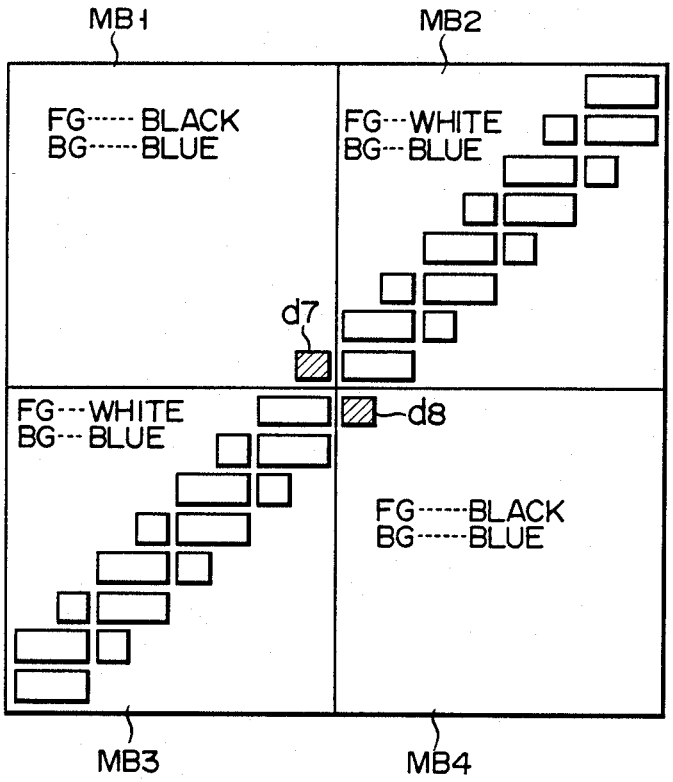
FIG. 43 shows a smoothing process for coloring the half-pixel element to be added according to a third embodiment of the invention.

Color register 43, (shown in FIG. 44) stores foreground data FGD and background data BGD for each address prescribed by a clock such as that shown in FIG. 43. In this case, each data has a three bit structure and can express eight different colors.

The reading out of data from color register 43 is carried out in 6-bit unit for each data. In other words, the data of two blocks, e.g., MB1, MB2, is read out simultaneously. The reason for this is that the reading out of pattern data from picture memory 31 is done in eight-pixel units, i.e., in order to match the number of pixels in two blocks. The reading out of data from color register 43 is carried based on address x, y-1 for the reading out from picture memory 31, for example, of image data of the preceding horizontal line. Consequently, foreground data FGD and background data BGD is stored in color register 43 displaced by one line in relation to the pattern data of memory 31. The foreground data FGD and background data BGD read out from color register 43 is latched by latch circuit 44 based on latch pulse CLP from timing generator 33. (See FIG. 44.) This latch data is selected in one-block units based on color switch pulse CCW supplied from timing generator 33 in switch circuit 45, and supplied to latch circuit 46. Latch circuit 46 latches the input data based on latch pulse CCK supplied from timing generator 33. Then, latch circuit 46 latches the foreground data FGD1, FGD2 and background data BGD1, BGD2 of each block in correspondence to the display period of that block.

The background and foreground data BGD and FGD latched by latch circuit 46 are supplied to color selection section 47, and are selected based on signals FP, DP, BP, DBG.

Figure 48:
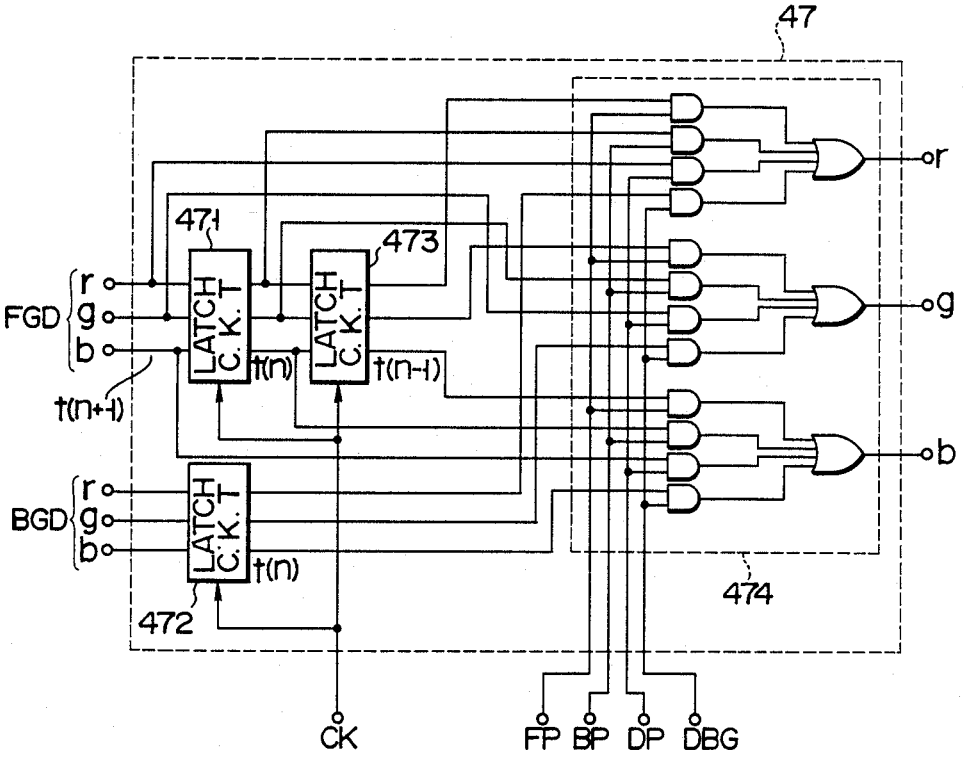
FIG. 48 shows one example of a color select section in the third embodiment.

The structure of color selection section 47 is shown in FIG. 48. First, foreground and background data FGD, BGD input to color selection section 47 are delayed for one cycle of display clock CK by latch circuits 471, 472, respectively. Therefore, the pattern data of current display pixel S4 supplied to polarity inverter 1C shown above in FIG. 46 and the two color data FGD, BGD corresponding to pixel S4 are synchronized.

With this embodiment, in the addition of half-pixel pattern d, when pixel S3 on the left of current display pixel S4 or pixel S5 on the right side is a structural element of the slanted line pattern, the half-pixel pattern d is colored using foreground data FGD of either pixel S3 or pixel S5. Therefore, by connecting latch circuit 473 after latch circuit 471 foreground data FGD corresponding to pixel S3 is output at the same timing as foreground data FGD corresponding to current display pixel S4. Foreground data FGD corresponding to pixel S5 is obtained at the same timing as foreground data FGD corresponding to pixel S4 due to the presence of the input stage of latch circuit 471.

Figure 49:
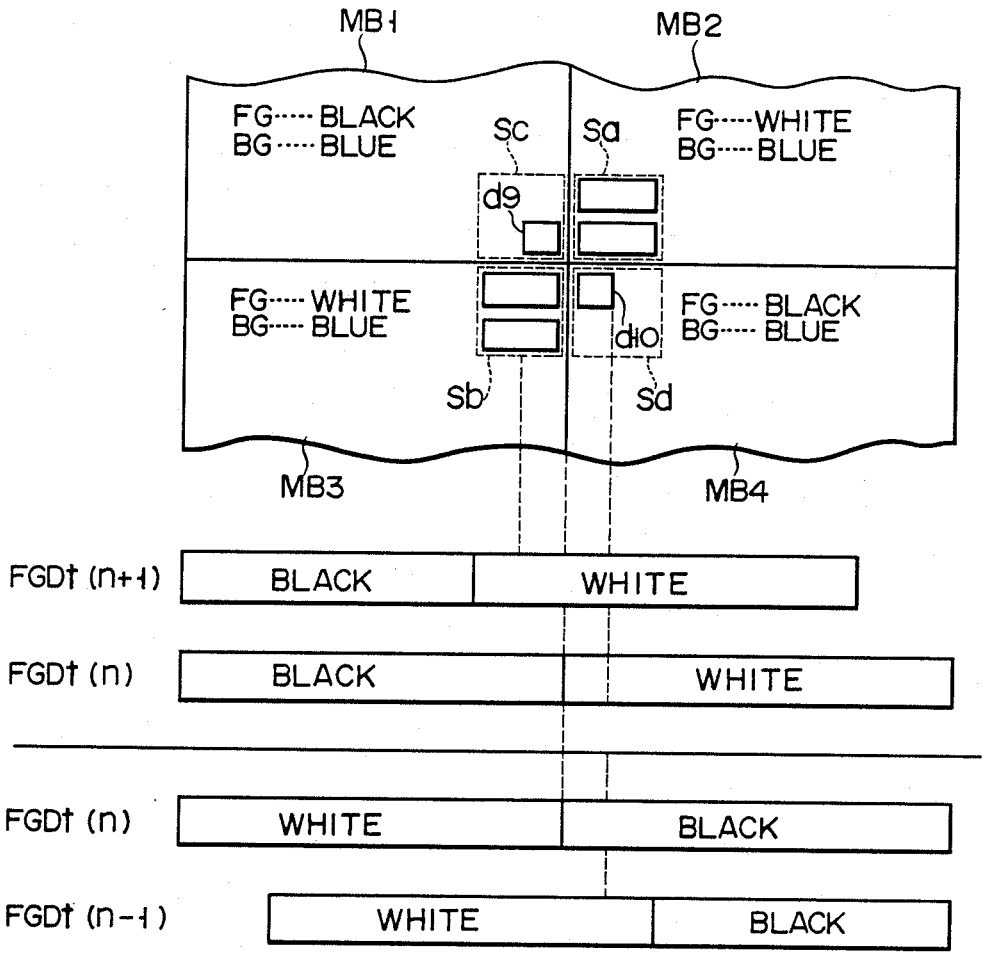
FIG. 49 shows the advantages of the third embodiment.

Foreground and background data FGD, BGD obtained in this way is alternatively selected by selection section 474 based on signals FP, BP, DP, DBG. This selection process will now be described with reference to FIGS. 48, 49.

First, when pixel sa is the current display pixel S4, signal DP becomes high level, and foreground data FGD output from latch circuit 471 shown in FIG. 47 at timing t(n) is selected. Then, pixel sa displays white, which is the designated foreground FG of block MB2. When pixel sb is the current display pixel S4, it also displays white, which is the designated foreground FG of block MB3.

When pixel sc is the current display pixel S4, the detected slanted line pattern has the pixel sa on right side of pixel sc as a structural element. Accordingly, signal BP1 becomes high level and with it signal BP also becomes high level. Consequently, foreground data FGD at timing t(n+1) corresponding to pixel sa is selected. Then half-pixel pattern d9 is displayed in the same white as pixel sa regardless of the fact that it is in a block MB1 for which the designated foreground FG color is black.

In the same way, when pixel sd is the current display pixel S4, signal FP becomes high level. Therefore, foreground data FGD of timing t(n−1) corresponding to pixel sb is selected, and half-pixel pattern d10 is displayed in white.

The color data FGD or BGD output from color selection section 47 is supplied to gate circuit 48 shown in FIG. 44. Gate circuit 48 supplies input data to the image tube drive circuit only during the image display period in accordance with gate signal SG.

According to this embodiment, the half-pixel pattern d to be added can be displayed in exactly the same color as the detected slanted line pattern so the image display effect can be even further improved with this smoothing process.

The present invention can be applied not only to the image display systems of the interlace scanning method, but also to the image display systems of the non-interlace scanning method.

What is claimed is:

1. A smoothing device comprising:

a picture memory for storing pattern data representing a pattern to be displayed on a display device, said pattern being formed of picture elements formed by line-scanning a first and second field;

data storage means coupled to said picture memory for storing pattern data consisting of nine picture elements Ct(n−1), Ct(n), Ct(n+1), Rt(n−1), Rt(n), Rt(n+1), Ft(n−1), Ft(n), and Ft(n+1), in which C represents pattern data of a current horizontal line, t(n) represents a timing of a currently scanning picture element, t(n−1) and t(n+1) are equivalent timings immediately preceding and following, respectively, said timing t(n), R′ represents pattern data of a horizontal line one line above the current horizontal line, and F represents pattern data of a horizontal line one line below the current horizontal line;

adding-decision means for deciding whether or not to add to said pattern a half-pixel pattern having half the width of said picture element, at display timing t(n) of one field of current display picture element Ct(n), in accordance with any one of the following conditions expressed by said pattern data stored in said data storage means:

$$\overline{Rt(n-1)}\cdot Rt(n)\cdot Ct(n-1)\cdot\overline{Ct(n)}\cdot\overline{Ct(n+1)}=1$$

$$\overline{Rt(n-1)}\cdot Rt(n)\cdot Ct(n-1)\cdot\overline{Ct(n)}\cdot\overline{Ft(n)}=1$$

$$Rt(n-1)\cdot Rt(n)\cdot\overline{Rt(n+1)}\cdot Ct(n-1)\cdot\overline{Ct(n)}\cdot\overline{Ct(n+1)}\cdot\overline{Ft(n-1)}\cdot Ft(n)=1;$$

and display means for displaying on said display device said pattern modified by said half-pixel pattern in accordance with the decision made by said adding-decision means, so that the displayed pattern has relatively smooth contours.

2. The smoothing device according to claim 1, further comprising:

deleting-decision means for deciding whether or not to delete from said pattern the half-pixel pattern, at display timing t(n) of one field of current display picture element Ct(n), in accordance with any one of the following conditions expressed by said pattern data stored in said data storage means:

$$\overline{Rt(n-1)}\cdot\overline{Rt(n)}\cdot Rt(n+1)\cdot\overline{Ct(n-1)}\cdot Ct(n)\cdot\overline{Ft(n-1)}\cdot Ft(n)=1$$

$$\overline{Rt(n-1)}\cdot\overline{Rt(n)}\cdot\overline{Rt(n+1)}\cdot\overline{Ct(n-1)}\cdot Ct(n)\cdot Ct(n+1)\cdot Ft(n-1)=1.$$

3. The smoothing device according to claim 1, wherein said adding-decision means further adds the half-pixel pattern at the display timing t(n) of the current display picture element Ct(n), in accordance with any one of the following conditions:

$$Rt(n-1)\cdot Rt(n)\cdot\overline{Rt(n+1)}\cdot\overline{Ct(n-1)}\cdot\overline{Ct(n)}\cdot Ct(n+1)\cdot\overline{Ft(n)}\cdot\overline{Ft(n+1)}=1$$

$$Rt(n-1)\cdot Rt(n)\cdot\overline{Ct(n-1)}\cdot\overline{Ct(n)}\cdot\overline{Ct(n+1)}\cdot\overline{Ft(n-1)}\cdot Ft(n)\cdot\overline{Ft(n+1)}=1.$$

4. The smoothing device according to claim 3, further comprising:

deleting-decision means for deciding whether or not to delete from said pattern the half-pixel pattern, at display timing t(n) of one field of current ispaly picture element Ct(n), in accordance with any one of the following conditions expressed by said pattern data stored in said data storage means:

$$Rt(n-1)\cdot\overline{Rt(n)}\cdot Rt(n+1)\cdot\overline{Ct(n-1)}\cdot Ct(n)\cdot\overline{Ft(n-1)}\cdot Ft(n)=1$$

$$\overline{Rt(n-1)}\cdot\overline{Rt(n)}\cdot\overline{Rt(n+1)}\cdot\overline{Ct(n-1)}\cdot Ct(n)\cdot Ct(n+1)\cdot Ft(n-1)=1.$$

5. A smoothing device comprising:

a picture memory for storing pattern data representing a pattern to be displayed on a display device, said pattern being formed of picture elements formed by line-scanning a first and second field;

data storage means coupled to said picture memory for storing pattern ata consisting of nine picture elements Ct(n−1), Ct(n), Ct(n+1), Rt(n−1), Rt(n), Rt(n+1), Ft(n−1), Ft(n), and Ft(n+1), in which C represents pattern data of a current horizontal line, t(n) represents a timing of a currently scanning picture element, t(n−1) and t(n+1) are equivalent timings immediately preceding and following, respectively, said timing t(n), R represents pattern data of a horizontal line one line above the current horizontal line, and F represents pattern data of a horizontal line on line below the current horizontal line;

adding-decision means for deciding whether or not to add to said pattern a half-pixel pattern having half the width of said picture element, at display timing t(n) of one field of current display picture element Ct(n), in accordance with any one of the following conditions expressed by said pattern data stored in said data storage means:

$$\overline{Rt(n-1)}\cdot Rt(n)\cdot Ct(n-1)\cdot\overline{Ct(n)}\cdot\overline{Ct(n+1)}=1$$

$$\overline{Rt(n-1)}\cdot Rt(n)\cdot Ct(n-1)\cdot\overline{Ct(n)}\cdot\overline{Ft(n)}=1$$

$$Rt(n-1)\cdot RT(n)\cdot\overline{Rt(n+1)}\cdot Ct(n-1)\cdot\overline{Ct(n)}\cdot\overline{Ct(n+1)}\cdot\overline{Ft(n-1)}\cdot Ft(n)=1;$$

coloring-setting means for setting the color of said half-pixel pattern so that this color is equal to the color of said pattern; and display means for displaying on a display device said pattern modified by said half-pixel pattern in accordance with the decision made by said adding-decision means and the coloring setting made by said coloring-setting means, so that the displayed pattern has relatively smooth contours.

6. The smoothing device according to claim 5, wherein said adding-decision means further adds the half-pixel pattern at the display timing t(n) of one field of the current display picture element Ct(n), in accordance with any one of the following conditions:

$$Rt(n-1)\cdot Rt(n)\cdot\overline{Rt(n+1)}\cdot\overline{Ct(n-1)}\cdot\overline{Ct(n)}\cdot Ct(n+1)\cdot\overline{Ft(n)}\cdot\overline{Ft(n+1)}=1$$

$$Rt(n-1)\cdot Rt(n)\cdot\overline{Ct(n-1)}\cdot\overline{Ct(n)}\cdot\overline{Ct(n+1)}\cdot\overline{Ft(n-1)}\cdot Ft(n)\cdot\overline{Ft(n+1)}=1.$$

* * * * *